US006375799B1

(12) United States Patent
Halmschlager et al.

(10) Patent No.: US 6,375,799 B1
(45) Date of Patent: Apr. 23, 2002

(54) PROCESS AND APPARATUS FOR PRODUCING A FIBROUS MATERIAL WEB

(75) Inventors: Günter Halmschlager, Krems; Josef Bachler, Ulmerfled-Hausmening; Christoph Merckens, Schwertberg, all of (AT)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/493,674

(22) Filed: Jan. 28, 2000

(30) Foreign Application Priority Data

Jan. 28, 1999 (DE) ..... 199 30 943

(51) Int. Cl.[7] ..... D21F 11/00

(52) U.S. Cl. ..... 162/186; 162/203; 162/198; 162/132; 162/303; 162/304; 162/183; 162/202

(58) Field of Search ..... 162/186, 203, 162/198, 132, 303, 304, 183, 202

(56) References Cited

U.S. PATENT DOCUMENTS

| | | | | |
|---|---|---|---|---|
| 3,846,232 A | | 11/1974 | Kankaanpaa | |
| 4,028,175 A | | 6/1977 | Schiel | |
| 4,614,566 A | | 9/1986 | Koponen et al. | |
| 4,808,266 A | * | 2/1989 | Faurie | 162/102 |
| 6,159,341 A | * | 12/2000 | Egelhof et al. | 162/303 |

FOREIGN PATENT DOCUMENTS

| | | |
|---|---|---|
| AT | 16717 | 3/1984 |
| DE | 1942348 | 3/1971 |
| DE | 2413421 | 10/1974 |
| DE | 2501534 | 9/1975 |
| EP | 851058 | 7/1998 |
| EP | 894894 | 2/1999 |

* cited by examiner

*Primary Examiner*—Stanley S. Silverman
*Assistant Examiner*—Mark Halpern
(74) *Attorney, Agent, or Firm*—Greenblum & Bernstein P.L.C.

(57) ABSTRACT

Process and apparatus for producing a fibrous material web from a fibrous material suspension. The process includes conveying the fibrous material suspension between two endless, continuously revolving porous belts positioned to form a twin wire zone, removing a part of the suspension fluid through the porous belts so that the fibrous material web begins forming between the belts, guiding the two endless belts and the material web being formed therebetween through uniform pressure drainage elements, and removing additional suspension fluid with the uniform pressure drainage elements. The process further includes supplying an additive though at least one of the belts to the forming fibrous material web in a vicinity of the uniform pressure drainage, and one of controlling and regulating the supply of the additive to provide a particular ratio between quality levels of a top side of the forming web and a web underside of the forming web. The apparatus includes two endless, continuously revolving belts positioned to form a twin wire zone. The twin wire zone includes an inlet adapted to receive a suspension flow and the belts are porous so as to enable flow of suspension fluid therethrough. Uniform pressure drainage elements are positioned such that the belts, with the fibrous material therebetween, are guided through, and in contact with, the uniform pressure drainage elements. The uniform pressure drainage elements include a portion supporting the belts having at least one of a perforated and recessed surface adapted for receiving suspension fluid, so that drainage occurs through an essentially pulsation-free drainage pressure. A supply device for an additive can be coupled to at least one of the uniform pressure drainage elements, and a control or regulation device is provided to vary at least one of a volume flow and a pressure of the additive to be supplied.

24 Claims, 2 Drawing Sheets

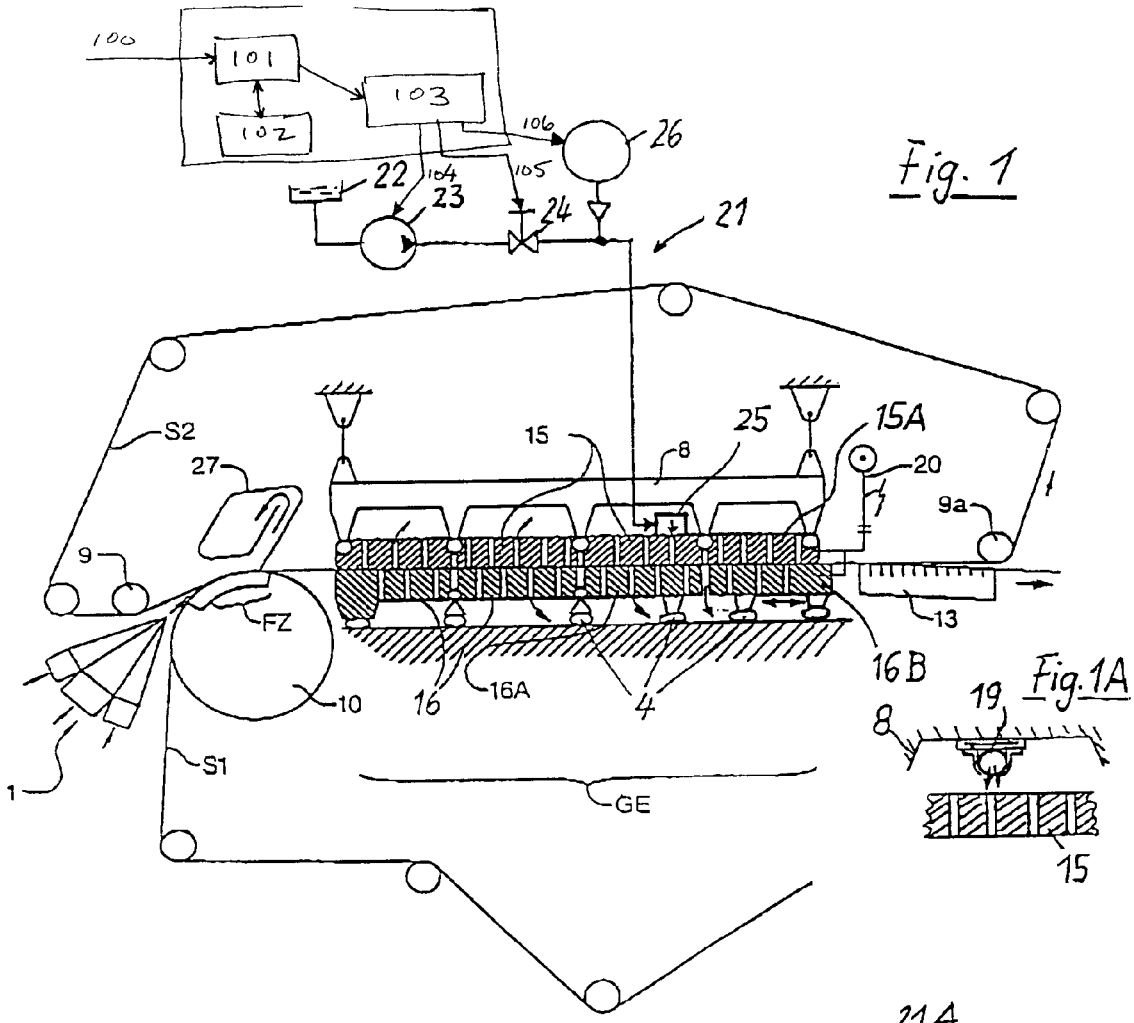
Fig. 1
Fig. 1A
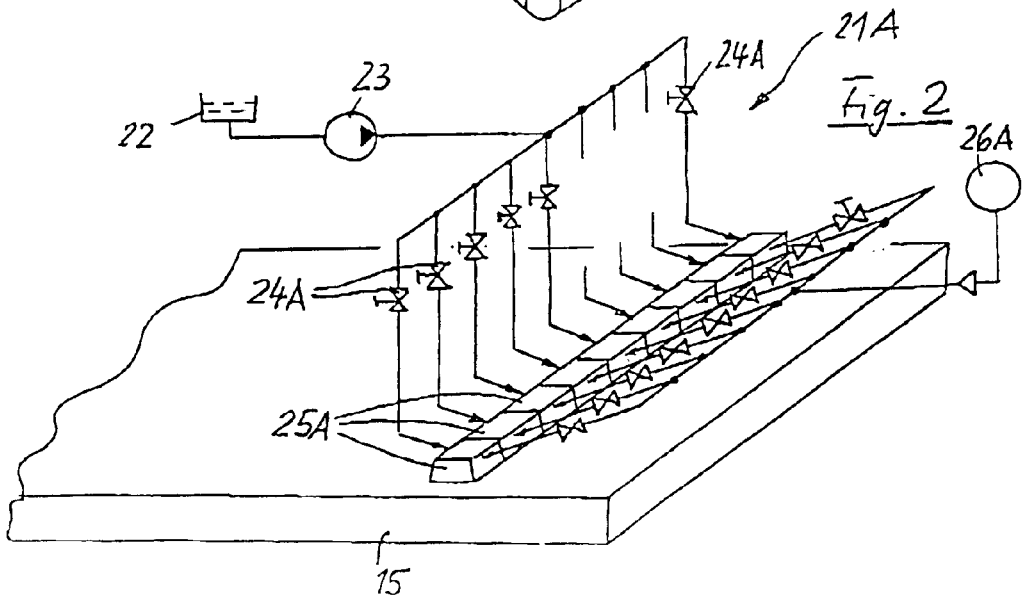
Fig. 2

40
41
42
43
44
45
46
47
47a
48
48a
49
50
51
52
53
54
55
31
32
33
34
35
36
37
38
39
48'

PROCESS AND APPARATUS FOR PRODUCING A FIBROUS MATERIAL WEB

CROSS-REFERENCE TO RELATED APPLICATIONS

The present application claims priority under 35 U.S.C. §119 of German Patent Application No. 199 03 943.7, filed on Jan. 28, 1999, the disclosure of which is expressly incorporated by reference herein in its entirety.

BACKGROUND OF THE INVENTION

1. Field of the Invention

The present invention relates to a process for producing a fibrous material web, e.g., a paper or cardboard web, from a fibrous material suspension. The invention also relates to a device for carrying out the process.

2. Discussion of Background Information

A starting point for the instant invention is European Patent Application EP 0 894 894, which was not published prior to the above-noted priority date of the instant application. EP 0 894 894, which is expressly incorporated by reference herein in its entirety, discloses the formation of a fibrous material web between two endless, water-permeable belts, preferably wire belts, which occurs in a known manner by virtue of the fact that a portion of the suspension fluid is removed through the belts. In a part of the web-forming zone, the belts, together with the fibrous material web being forming between them, is guided between so-called uniform pressure drainage elements, in the form of, e.g., perforated plates. A disclosed embodiment provides for an additive, e.g., ink, filler, adhesive, draining agent, to be supplied to the fibrous material web being formed by flowing through one of the uniform pressure drainage elements and through the porous belt traveling atop the forming web.

SUMMARY OF THE INVENTION

The present invention improves the web forming process and the apparatus for performing the process to the extent that certain properties of the finished fibrous material web are improved.

As a result, a number of requirements should be fulfilled, if possible. For example, the so-called "two-sidedness" of the fibrous material web can be deliberately influenced, i.e., to achieve as little two-sidedness as possible so that substantially uniform properties occur on both sides of the web or to produce an "intentional two-sidedness" so that the two sides of the fibrous material web have different properties.

An additive can be supplied to the fibrous material web, and a rinsing-out of the additive should be prevented to the greatest extent possible during subsequent draining of the fibrous material web.

When producing multi-ply products, the fibrous material web produced to be united with another fibrous material web should include a ply bond between the two webs that is as high as possible.

The cross profile of particular web properties should be influenced and/or adjusted.

The intensity of drainage in particular partial regions of the web-forming zone can be influenced and/or adjusted.

Accordingly, the process in accordance with the instant invention provides that the supply of the additive is controlled or regulated such that the fibrous material web formed has the respectively deliberate (i.e., either slight or clearly perceptible) two-sidedness. In other words, the supply of the additive is controlled or regulated so that, with regard to a particular surface quality (or with regard to a particular quality level that can be measured on the surfaces of the web), a particular ratio is produced between the properties or quality levels of the two sides of the web.

In an exemplary embodiment of the process according to the invention, during a continuous manufacturing process, a particular property can be continuously measured on both sides of the traveling fibrous material web (e.g., paper web). Thus, a continuous determination may be made as to whether the intended degree of two-sidedness is being achieved.

If the degree of two-sidedness deviates from an intended value of two-sidedness (i.e., a set point), then a volume flow and/or a pressure of the additive being supplied, for example, can be varied so that the two-sidedness of the material web being formed approaches the set point, e.g., with the aid of a closed control loop. By varying the pressure, the penetration depth of the additive, among other things, can be deliberately controlled, which can lead to an optimization of the distribution of additive in the Z-direction.

A particularly important further concept of the invention is that a fine fibrous material suspension can be used as an additive. The fine fibrous material suspension can be obtained, e.g., from suspension fluid removed in a beginning region of a twin wire zone, i.e., the so-called "white water." In this instance, a definite, e.g., particularly high, fines content can be produced on one of the two sides of the fibrous material web or on both sides of the web. The level of the fines content is important, for example, for the printability of the finished fibrous material web. In a similar manner, it is important in the production of a multi-ply product that, before the two fibrous material webs are united, the fines content on the web sides to be joined together, or arranged to come into contact with one another, can be increased to the greatest extent possible. Other possible additives include, e.g., filler suspension, polymer solution, adhesive solution, or starch solution, or an ink that is supplied, for example, at a particular location.

When utilizing the process according to the invention, the location of the additive supply is in a vicinity of the so-called "uniform pressure drainage." This is the region of web formation in which drainage occurs through the use of an essentially pulsation-free drainage pressure. In this regard, in a relevant part of the web-forming zone, drainage pressure either remains essentially the same or changes almost continuously, e.g., increases. Consequently, drainage of this type differs from the drainage method normally used in the beginning region of the web formation in which, with the aid of so-called "forming strips," pressure pulsations are produced in the suspension while it is present between the belts. This results in the fibrous material remaining as uniformly distributed as possible during the web formation process.

A particular advantage of the supply location (for the additive) in the vicinity of the uniform pressure drainage is that, after the supply of the additive, the subsequent drainage can be controlled so that as little as possible of the supplied additive is lost. This is achieved, e.g., by virtue of the fact that the additive is supplied at the beginning region or in the middle region of the uniform pressure drainage zone and that, downstream of the supply point, the intensity of the subsequent drainage can be reduced on the relevant side of the web, and may even be, e.g., completely suppressed in a particular section. At the same time, the intensity of drainage on the opposite web side can be increased through the use of, e.g., a vacuum and by providing increased perforation cross-sections in a particular region.

The prevention of drainage on the side of the web on which the additive has been supplied is possible, e.g., by virtue of the fact that either a closed, i.e., non-perforated, plate element is provided in a particular partial region of the uniform pressure drainage zone or a part of the perforation is closed, e.g., with the aid of a compressed air buffer. In any case, it can be assured that a very high retention of the supplied additives can be expected. Otherwise, the invention also assures that the fines and/or fillers contained in the fibrous material suspension from the beginning are retained to a higher percentage than previously in the fibrous material web being formed.

In an alternative embodiment, and with the aid of uniform pressure drainage elements of different permeabilities, it is possible to assure that drainage through one belt is more intense than the drainage through the other belt. In extreme cases, in a particular region of the uniform pressure drainage zone, the removal of suspension fluid through one of the two belts can be suppressed at least to a large extent, e.g., with the aid of a water-impermeable uniform pressure drainage element. The latter assures that, on this side of the fibrous material web being formed, the fines and/or fillers that are supplied with the fibrous material suspension cannot escape. As a result, a fibrous material web is obtained which has a considerably higher proportion of fines and/or fillers on one side of the web.

The present invention also includes possibly advantageous measures for the additional control of the drainage intensity and for the most uniform possible distribution of the fibrous material, which can be utilized in combination or independently of the other features of the invention.

Numerous other possibilities for embodying the process according to the invention and the device according to the invention are contained in the Patent Application EP 0 894 894 mentioned at the beginning. Further, it is expressly emphasized that all features described in the European application, which was unpublished at the time of the filing of the priority application, can be combined with the features of the current application. Accordingly, the disclosure of EP 0 894 894 is expressly incorporated by reference herein in its entirety.

The present invention is directed to a process for producing a fibrous material web from a fibrous material suspension. The process includes conveying the fibrous material suspension between two endless, continuously revolving porous belts positioned to form a twin wire zone, removing a part of the suspension fluid through the porous belts so that the fibrous material web begins forming between the belts, guiding the two endless belts and the material web being formed therebetween through uniform pressure drainage elements, and removing additional suspension fluid with the uniform pressure drainage elements. The process further includes supplying an additive though at least one of the belts to the forming fibrous material web in a vicinity of the uniform pressure drainage, and one of controlling and regulating the supply of the additive to provide a particular ratio between quality levels of a top side of the forming web and a web underside of the forming web.

According to a feature of the present invention, the supply of the additive can be one of controlled and regulated so that the quality levels for each side of the forming web are substantially the same.

In accordance with another feature of the invention, the supply of the additive can be one of controlled and regulated so that the quality levels for each side of the forming web are unequal.

In accordance with a further feature of the present invention, the supply of the additive to be one of controlled and regulated can be a volume flow.

According to a still further feature of the invention, a pressure of the supply of the additive may be one of controlled and regulated. The pressure of the additive can be one of controlled and regulated through the admixture of a propellant. The propellant can include at least one of compressed air and steam.

The additive may be supplied in one of a beginning region and a middle region of the uniform pressure drainage elements. An intensity of drainage can be reduced on a side of the web on which the additive is supplied at a location downstream from where the additive is supplied.

Further, the additive can include a fine fibrous material. The fine fibrous material may include the suspension fluid removed in a beginning region of the twin wire zone. While the fibrous material web is still moist, and the process can further include uniting the still moist fibrous material web with another fibrous material web, thereby producing a multi-ply fibrous material web. Sides of the still moist web and of the another fibrous web having an increased fines content are brought together in uniting the still moist fibrous material web with the another fibrous material web.

In accordance with another feature of the instant invention, the additive can be sectionally supplied to the region of the uniform pressure drainage elements by a plurality of individually controllable section lines distributed across a width of the web.

Further, the fibrous material web can include one of a paper and a cardboard web. The quality level may be related to fines content, and the revolving porous belt can include wire belts.

The present invention is directed to a process for producing a fibrous material web from a fibrous material suspension. The process includes conveying the fibrous material suspension between two endless, continuously revolving porous belts positioned to form a twin wire zone, removing a part of the suspension fluid through the porous belts so that the fibrous material web begins forming between the belts, guiding the two endless belts and the material web forming therebetween through uniform pressure drainage elements, and removing additional suspension fluid with the uniform pressure drainage elements so that, in a vicinity of the uniform pressure drainage elements, drainage occurs through the one of the two belts more intensely than through the other belt. In this manner, different quality levels are produced on the sides of the fibrous material web being formed.

In at least one partial region of the uniform pressure drainage elements, the process may further include suppressing removal of suspension fluid through one of the two belts. Further, the removal of the suspension fluid may be suppressed via a water-impermeable uniform pressure drainage elements.

According to a feature of the instant invention, the uniform pressure drainage elements located on opposite sides of the fibrous material web being formed may have different permeabilities.

The present invention is directed to an apparatus for producing a fibrous material web from a fibrous material suspension. The apparatus includes two endless, continuously revolving belts positioned to form a twin wire zone. The twin wire zone includes an inlet adapted to receive a suspension flow and the belts are porous so as to enable flow of suspension fluid therethrough. Uniform pressure drainage elements are positioned such that the belts, with the fibrous material therebetween, are guided through, and in contact with, the uniform pressure drainage elements. The uniform pressure drainage elements include a portion supporting the belts having at least one of a perforated and recessed surface adapted for receiving suspension fluid, so that drainage occurs through an essentially pulsation-free drainage pressure. A supply device for an additive can be coupled to at least one of the uniform pressure drainage elements, and a control or regulation device is provided to vary at least one of a volume flow and a pressure of the additive to be supplied.

The supply device can be coupled to a propellant supply device. The propellant supply can include at least one of compressed air and steam.

Further, the supply device may be coupled to one of a beginning region and a middle region of the uniform pressure drainage elements. At least one uniform pressure drainage element can be positioned downstream, relative to a belt travel direction, from the supply device coupling, and the at least one uniform pressure drainage element may be adapted to reduce drainage intensity relative to others of the uniform pressure drainage elements. The at least one uniform pressure drainage element can include a non-perforated plate.

According to a feature of the invention, the supply device can include a plurality of sections arranged across a with of the web, and an individually controllable section line feeds into each of the plurality of sections, thereby supplying a partial quantity of the additive.

In accordance with another feature of the invention, at least one of the uniform pressure drainage elements can be associated with a movable cleaning device.

Moreover, a distance between successively arranged uniform pressure drainage elements in a belt travel direction can be variable. At least one of the successively arranged uniform pressure drainage elements can be shiftable relative to the other, and the distance can be between approximately 0 and 50 mm.

In accordance with a further feature of the present invention, the uniform pressure drainage elements can include a plate-shaped perforated drainage element positioned against one of the two belts, and a plurality of forming strips positioned against the other of the two belts and opposite the plate-shaped element. Widths of the forming strips, relative to a web travel direction, may differ from one another. Further, distances between the forming strips may differ from one another. Still further, one of the plate-shaped drainage element and the forming strips can be flexibly pressed against the relevant belt.

The present invention is directed to an apparatus for producing a fibrous material web from a fibrous material suspension. The apparatus includes two endless, continuously revolving belts positioned to form a twin wire zone, where the twin wire zone includes an inlet adapted to receive a suspension flow and the belts being porous so as to enable flow of suspension fluid therethrough. Uniform pressure drainage elements are positioned such that the belts, with the fibrous material therebetween, are guided through, and in contact with, the uniform pressure drainage elements. The uniform pressure drainage elements located on one side of the belts enable greater drainage than through the uniform pressure drainage elements on the other side of the belts.

According to yet another feature of the instant invention, the uniform pressure drainage elements on the other side of the belt can include non-porous pressing surfaces.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1 illustrates is a schematic side view of a twin-wire former with an additive supply;

FIG. 1A illustrates a detailed portion of the invention depicted in FIG. 1;

FIG. 2 illustrates an oblique view of an alternative embodiment of the additive supply device depicted in FIG. 1;

DETAILED DESCRIPTION OF THE PRESENT INVENTION

Figures 3, 4:
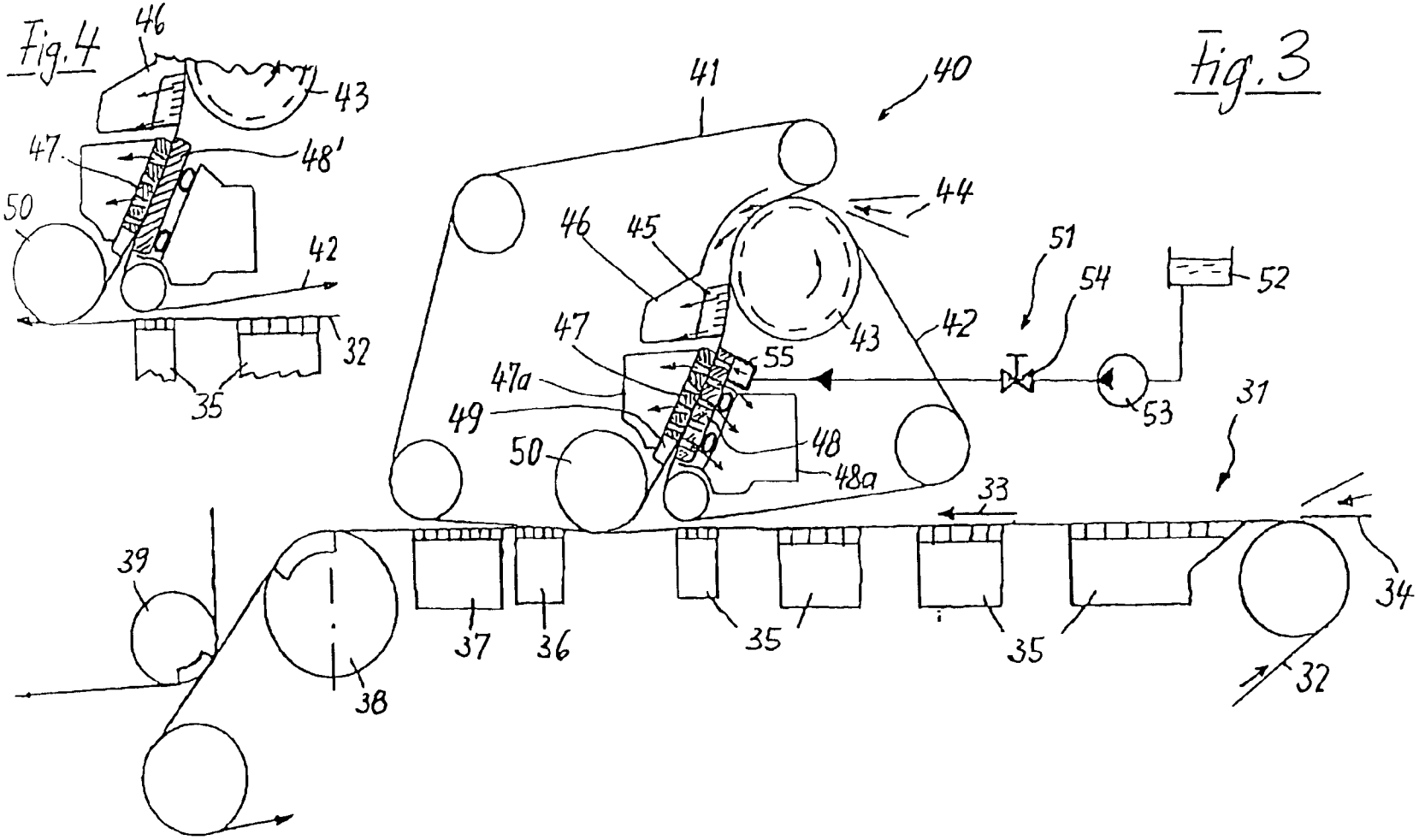
FIG. 3 illustrates a former for producing a two-ply fibrous material web.
FIG. 4 illustrates an alternative embodiment of a portion of the invention depicted in FIG. 3.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In FIG. 1, a headbox 1, e.g., a multi-layer headbox, is arranged to "shoot" a fibrous material suspension flow into a nip formed by (and/or between) two wire belts S1 and S2 at a beginning of a twin wire zone. At this point, wire belts S1 and S2 travel over a forming suction roll 10 which is located inside loop of lower wire S1. Upper wire S2 can be guided to travel from a wire guide roll 9 onto forming roll 10, so as to wind around forming roll 10 in a vicinity of a forming zone FZ. Forming strips (not shown) can be provided inside the loop of upper wire S2. In forming zone FZ, the formation of a fibrous material web begins by removal of suspension fluid through wires S1 and S2.

The removed suspension fluid flows in a known manner, partly through forming roll 10 and partly through a catch container 27 located inside the loop of upper wire S2.

Downstream of forming zone FZ, i.e., relative to the web travel direction, a uniform pressure drainage zone GE, comprised of a plurality of uniform pressure drainage elements 15 and 16, is provided. Drainage elements 15 and 16 can be, e.g., plate segments located one after the other in the web travel direction and can be connected to one another in an articulated fashion. These plate segments can also be perforated so as to permit removal of further suspension fluid. As depicted in FIG. 1, the perforation can be formed as essentially the same in all of the plate segments. However, it is also contemplated that, the perforation diameter and/or the number of perforations can be selected as different from segment to segment. As an example, cylindrical bores having a diameter of, e.g., approximately 5–50 mm, and/or conically widening bores having a diameter of, e.g., 10–50 mm at the bigger end, and a diameter of, e.g., 5–45 mm at the smaller end. Further, either additionally or alternatively, the perforations can include slots, similar in general to those used in wet suction boxes, having a width of, e.g., approximately 5–200 mm. Instead of bores disposed perpendicular to the wire plane, oblique bores can be provided.

A part of the suspension fluid can also be removed through a gap located between two adjacent plate segments, e.g., as depicted between plate segments 16A and 16B. Such a gap may have a width of, e.g., approximately 0–50 mm. To control the drainage intensity, the internal width of the above-mentioned gap can be changed by shifting plate segment 16B in the direction of the double arrow. Upper plate segments 15 and 15A can be fastened to a support structure 8 via their articulations or connecting joints. Lower plate segments 16, 16A, and 16B can be arranged to rest against pneumatic hoses 4. The internal pressure in each pneumatic hose 4 can be individually controlled so that each of the plate segments can be pressed flexibly against the inside of lower wire S1 with a force that can be freely selected. If necessary, plate segments 15 and 16 can be heated electrically, e.g., as is schematically indicated by reference character 20 to a temperature of, e.g., approximately 10–90° C. In addition, if necessary, an oscillation producer or oscillator (not shown in the drawing) can be connected to the plate segments. A suction separator 13 is disposed at the end of the twin wire zone in a known manner. This assures that the fibrous material web produced separates from the upper wire S2 and continues to travel with the lower wire S1, from which the web is removed in a known manner and is supplied to other treatment stations.

According to the present invention, one of upper plate segments 15, e.g., a centrally located plate segment 15, can be provided with a supply device for an additive, which is indicated as a whole with reference character 21. Supply device 21 can include a storage tank 22, a pump 23, a control valve 24, a distribution chamber 25 arranged on the centrally located plate segment 15, as well as associated tube lines.

Moreover, if necessary or desired, a propellant from a reservoir 26, e.g., compressed air (preferably heated, e.g., to a temperature approximately 10–70° C. in adjustment with the temperature of the stock) or steam, can be supplied to the additive, e.g., between control valve 24 and distribution chamber 25 for the purpose of controlling a penetration depth of the additive in the material web being formed. In this regard, a pressure of the propellant can be, e.g., approximately 0.1–20 bar. Of course it is also noted that the different additives can require different volume flows and/or different pressures. By way of example, white water can require a maximum volume flow of approximately 100 l/(m·min). At the point of application, the pressure for the additive can be, e.g., approximately 0.1–5 bar relative to the atmosphere. Moreover, the penetration depth of the additive, which can be as much as the entire thickness of the web, depends upon the web, the speed, and the pressure applied. In contrast to FIG. 1, plate segment 15A, which is arranged to immediately follow centrally located plate segment 15 that is coupled to supply device 21, can be formed as a closed (without perforation) plate. FIG. 1A illustrates a cleaning device in the form of a shower pipe 19, which can be moved back and forth along support device 8.

Moreover, the properties to be controlled are measured on the running machine(or in the lab in constant time intervals) are transmitted to the program module 101 by signal line 100. The set (reference) points for the controlled property, and, possibly for the whole cross-profile, are stored in memory 102. Module 101 evaluates the difference between the actual and the measured values and transmits the difference as a signal to control unit 103. Control unit 103 evaluates the settings for the actuators for the speed of pump 23, the openings of valve 24, and adjusts the pressure in propellant 26 in order to reduce the measured difference between the actual and measured values. The control loop operates until the evaluated difference is lower than an acceptable pre-set value.

As a result, the present invention can adjust the two-sidedness of various web properties, including, e.g., fines content, brightness, printability, Scott bond, etc. Of course, because of the number of different additives, the two-sidedness of various web properties can be influenced by the present invention. In certain instances, the invention can be utilized to maintain the properties of various web qualities on each web surface to be substantially the same. Alternatively, the invention can also be utilized to maintain the properties of various web qualities on each web surface to be different, and, preferably at a predetermined ratio. By way of example, ratios for some properties can be as follows: Fines content ratio between approximately 1:1 and 0.2:2; brightness ratio between approximately 1:1 and 0.5:2; printability ratio between approximately 1:1 and 0.5:2; and Scott Bond ratio between approximately 1:1 and 0.7:2.

Of course, as noted above, not only can surface properties of the paper be influence or adjusted by the present invention, but also the distribution of the additives or fines in the z-direction. Examples of parameters which can show a different behavior in either two-sidedness or the z-direction of the web are fines content in the z-direction, bonding in the z-direction, printability on the surface, and brightness on the surface.

Online measurement of bonding can be done with ultrasonic pulses with a traversing or stationary sensor in the front of the reel up. Online measurement of brightness can be done with a traversing or stationary sensor in front of the first online coater or in front of the reel up. Further, online measurement of the printability and fines content can be done in the lab in constant time intervals from reeled up paper.

FIG. 2 illustrates a modified embodiment of the supply device, which is labeled as a whole as reference character 21A. Distribution chamber 25A can be subdivided into a plurality of sections over or across the web width. A supply line with an individually controllable control valve 24A can feed into each section or each distribution chamber 25A. If the addition of a propellant from a reservoir 26A is also to be provided, then the propellant can be likewise supplied to each section or distribution chamber 25A via an individually controllable line, either directly into the relevant section of distribution chamber 25A or into a section line downstream of control valve 24A. In this manner, the cross profile of one web property or another can be influenced (adjusted or controlled), e.g., the cross profile of the basis weight, the dry matter content, or the ash content.

The basic design of a multi-ply former shown in FIG. 3 corresponds to that depicted in FIG. 1 of EP 0 851 058, the disclosure of which is expressly incorporated by reference herein in its entirety. A fourdrinier wire unit 31 is shown, with an approximately horizontally guided wire belt 32, which travels in a direction depicted by arrow 33. A first fibrous material ply can be formed on wire belt 32 via headbox 34 and with the aid of a plurality of drainage elements 35. To form a second fibrous material ply, a twin-wire former 40, which can be arranged above unit 31, includes two wire belts 41 and 42 arranged to form the twin wire zone with each other. The twin wire zone begins at a forming roll 43. In the upper region of forming roll 43, a fibrous suspension flow can be "shot" between wires 41 and 42 via headbox 44. Wires 41 and 42, along with the fibrous material web being formed between them, are guided to travel from top to bottom of forming roll 43, and to wind around a drainage box 45, having a curvature oriented opposite to the curvature of forming roll 43. A water catch container 46 can be arranged adjacent forming roll 43 and drainage box 45.

Wires 41 and 42 can be guided between two plate-shaped uniform pressure drainage elements 47 and 48, and, thereafter, wire belts 41 and 42 can be separated. A suction separator 49 can be provided downstream of drainage element 47 and located inside the loop of wire belt 41, so that the second fibrous material ply produced can travel along with wire belt 41 to couch roll 50. Couch roll 50 is utilized to bring the two fibrous material plies in contact with each other so that they can be united to form a two-ply fibrous material web. The resulting two-ply fibrous material web can be separated from wire belt 41 by a suction separator 36 and can continue to travel together with wire belt 32 over, e.g., a suction box 37 and a wire suction roll 38.

The fibrous material web can be removed from wire belt 32 in a known manner by a felt band and a pickup roll 39 so as to supply the formed material web to a subsequent unit (e.g., a press section).

Plate-shaped drainage element 47 can be attached, e.g., to a water catch container 47*a*, and can include, e.g., cylindrical and conical extending perforations. Moreover, the perforations can even be a combination of cylindrical and conical perforations. Plate-shaped drainage element 48, which is located inside the loop of wire belt 42 and underneath forming roll 43, can be arranged to rest on a water catch container 48*a* via the interposition of pneumatic hoses. As a result, drainage element 48 can be flexibly pressed with an adjustable force against the inside of wire belt 42.

Similar to FIG. 1, a supply device 51 for an additive can be provided, which can include a storage tank 52, a pump 53, a control valve 54, and a distribution chamber 55. Distribution chamber 55 can be located at a beginning region of the uniform pressure drainage zone, i.e., at an upper end of plate-shaped drainage element 48. According to FIG. 3, plate-shaped drainage element 48 can be perforated over its entire length. However, is also possible that, underneath distribution chamber 55, plate 48 can be closed, at least in certain areas. As a result, it can be assured that the supplied additive penetrates as far as possible into the fibrous material web being formed and remains therein. Preferably, a fine fibrous material may be supplied as the additive. As a result, the underside of the second fibrous material ply formed in the twin-wire former can be enriched with fines. In the first fibrous material ply formed on fourdrinier wire unit 31, the top side has a relatively high fines content because the drainage only occurs toward the bottom. Consequently, the sides of the two fibrous material plies which have an increased fines content can be arranged to come into contact with each other on couch roll 50. As a result, an increased ply adhesion of the finished multi-ply product is produced.

For example, suspensions with high fines contents can be derived from stock prep fractionation or from white water from special positions in the machine. The fines content of this suspension is in the range of approximately 0.5–2% wt., and this suspension can be concentrated up to approximately 5% wt. and utilized as an additive in the manner discussed above.

FIG. 4 illustrates an alternative embodiment of the structure according to FIG. 3. In contrast to the exemplary embodiment depicted in FIG. 3, FIG. 4 illustrates a plate-shaped uniform pressure drainage element 48', which is positioned inside the loop of wire belt 42 and beneath forming roll 43. Drainage element 48' is formed as a closed plate and the supply device for an additive has been eliminated. In this embodiment, an enrichment of fines occurs in the uniform pressure drainage zone on the underside of the second fibrous material ply being produced because, in this instance, the drainage only takes place through the perforations of plate-shaped drainage element 47. Thus, the result is the same or similar to that achieved in the embodiment according to FIG. 3.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for producing a fibrous material web from a fibrous material suspension, the process comprising:

conveying the fibrous material suspension between two endless, continuously revolving porous belts positioned to form a twin wire zone;

removing a part of the suspension fluid through the porous belts so that the fibrous material web begins forming between the belts;

guiding the two endless belts and the material web being formed therebetween through uniform pressure drainage elements;

removing additional suspension fluid with the uniform pressure drainage elements;

supplying an additive though at least one of the belts to the forming fibrous material web in a vicinity of the uniform pressure drainage;

one of controlling and regulating the supply of the additive to provide a particular ratio between quality levels of a top side of the forming web and a web underside of the forming web.

2. The process according to claim 1, wherein the supply of the additive is one of controlled and regulated so that the quality levels for each side of the forming web are substantially the same.

3. The process according to claim 1, wherein the supply of the additive is one of controlled and regulated so that the quality levels for each side of the forming web are unequal.

4. The process according to claim 1, wherein the supply of the additive to be one of controlled and regulated is a volume flow.

5. The process according to claim 1, wherein a pressure of the supply of the additive is one of controlled and regulated.

6. The process according to claim 5, wherein the pressure of the additive is one of controlled and regulated through the admixture of a propellant.

7. The process according to claim 6, wherein the propellant comprises at least one of compressed air and steam.

8. The process according to claim 1, wherein the additive is supplied in one of a beginning region and a middle region of the uniform pressure drainage elements.

9. The process according to claim 8, wherein an intensity of drainage is reduced on a side of the web on which the additive is supplied at a location downstream from where the additive is supplied.

10. The process according to claim 1, wherein the additive comprises a fine fibrous material.

11. The process according to claim 10, wherein the fine fibrous material comprises the suspension fluid removed in a beginning region of the twin wire zone.

12. The process according to claim 10, wherein the fibrous material web is still moist, and the process further includes uniting the still moist fibrous material web with another fibrous material web, thereby producing a multi-ply fibrous material web.

13. The process according to claim 12, wherein sides of the still moist web and of the another fibrous web having an increased fines content are brought together in uniting the still moist fibrous material web with the another fibrous material web.

14. The process according to claim 1, wherein the additive is sectionally supplied to the region of the uniform pressure drainage elements by a plurality of individually controllable section lines distributed across a width of the web.

15. The process according to claim 1, wherein the fibrous material web comprises one of a paper and a cardboard web.

16. The process according to claim 1, wherein the quality level is related to fines content.

17. The process according to claim 1, wherein the revolving porous belt comprise wire belts.

18. A process for producing a fibrous material web from a fibrous material suspension, the process comprising:

conveying the fibrous material suspension between two endless, continuously revolving porous belts positioned to form a twin wire zone;

removing a part of the suspension fluid through the porous belts so that the fibrous material web begins forming between the belts;

guiding the two endless belts and the material web forming therebetween through uniform pressure drainage elements;

removing additional suspension fluid with the uniform pressure drainage elements so that, in a vicinity of the uniform pressure drainage elements, drainage occurs through the one of the two belts more intensely than through the other belt, whereby different quality levels are produced on the sides of the fibrous material web being formed.

19. The process according to claim 18, wherein, in at least one partial region of the uniform pressure drainage elements, the process further comprises suppressing removal of suspension fluid through one of the two belts.

20. The process according to claim 19, wherein the removal of the suspension fluid is suppressed via a water-impermeable uniform pressure drainage elements.

21. The process according to claim 18, wherein the uniform pressure drainage elements located on opposite sides of the fibrous material web being formed have different permeabilities.

22. The process according to claim 18, wherein the fibrous material web comprises one of a paper and a cardboard web.

23. The process according to claim 18, wherein the quality level is related to fines content.

24. The process according to claim 18, wherein the revolving porous belt comprise wire belts.

* * * * *